US010011121B2

(12) United States Patent
Clippingdale et al.

(10) Patent No.: US 10,011,121 B2
(45) Date of Patent: Jul. 3, 2018

(54) PRINTING ON CYLINDRICAL OBJECTS

(71) Applicant: Tonejet Limited, Royston, Hertfordshire (GB)

(72) Inventors: Andrew John Clippingdale, Royston (GB); John Lawton Sharp, Royston (GB); Simon Edwards, Royston (GB)

(73) Assignee: TONEJET LIMITED, Royston, Hertfordshire (GB)

( * ) Notice: Subject to any disclaimer, the term of this patent is extended or adjusted under 35 U.S.C. 154(b) by 0 days.

(21) Appl. No.: 15/307,076

(22) PCT Filed: Apr. 28, 2015

(86) PCT No.: PCT/GB2015/051229
§ 371 (c)(1),
(2) Date: Oct. 27, 2016

(87) PCT Pub. No.: WO2015/166228
PCT Pub. Date: Nov. 5, 2015

(65) Prior Publication Data

US 2017/0050446 A1 Feb. 23, 2017

(30) Foreign Application Priority Data

Apr. 28, 2014 (GB) ..... 1407440.5

(51) Int. Cl.
*B41J 3/407* (2006.01)

(52) U.S. Cl.
CPC ..... *B41J 3/4073* (2013.01)

(58) Field of Classification Search
CPC ..... B41J 3/4073; B41J 3/283; B41J 3/286
See application file for complete search history.

(56) References Cited

U.S. PATENT DOCUMENTS

| | | | |
|---|---|---|---|
| 6,769,357 | B1 | 8/2004 | Finan |
| 2009/0145511 | A1 | 6/2009 | Till |
| 2011/0232514 | A1 | 9/2011 | Putzer et al. |

(Continued)

FOREIGN PATENT DOCUMENTS

| | | |
|---|---|---|
| EP | 2605909 B1 | 1/2014 |
| WO | WO 93/11866 | 6/1993 |
| WO | WO 97/27056 | 7/1997 |

(Continued)

OTHER PUBLICATIONS

International Search Report dated Jul. 23, 2015, issued in PCT Application No. PCT/GB2015/051229.

*Primary Examiner* — Juanita D Jackson
(74) *Attorney, Agent, or Firm* — Dickinson Wright PLLC

(57) ABSTRACT

An apparatus for printing on cylindrical objects (31) comprises a plurality of printheads (32); and at least one holding device movable relative to the printheads (32) such that, in use, the holding device moves the object between the printheads. The path of the at least one holding device comprises a plurality of vertical sections (34) which are horizontally offset from one another. Each vertical section (34) comprises at least two identically orientated printheads (32) arranged such that they are vertically displaced from one another, with one directly above the others. The at least one holding device moves the object (31) between the at least two printheads (32) such that part or all of its path between the printheads is vertical.

35 Claims, 9 Drawing Sheets

(56) References Cited

U.S. PATENT DOCUMENTS

| | | | |
|---|---|---|---|
| 2013/0269551 | A1 | 10/2013 | Till |
| 2013/0293637 | A1 | 11/2013 | Bacon et al. |

FOREIGN PATENT DOCUMENTS

| | | | | |
|---|---|---|---|---|
| WO | WO 97/27058 | | 7/1997 | |
| WO | WO 98/32609 | | 7/1998 | |
| WO | WO 98/42515 | | 10/1998 | |
| WO | WO 01/30576 | | 5/2001 | |
| WO | WO 03/101741 | | 11/2003 | |
| WO | WO 2012/089549 | A1 | 7/2012 | |
| WO | WO 2012/131478 | A2 | 10/2012 | |
| WO | WO 2012131478 | A2 * | 10/2012 | ..... B41J 3/4073 |
| WO | WO 2012/147612 | A1 | 11/2012 | |

* cited by examiner

PRINTING ON CYLINDRICAL OBJECTS

This invention relates to printing apparatus and, more particularly, to apparatus designed for printing on substantially cylindrical objects such as cans or bottles.

BACKGROUND

Electrostatic printers of the type described in WO 93/11866 eject charged solid particles dispersed in a chemically inert, insulating carrier fluid by using an applied electric field to first concentrate and then eject the solid particles. A single printhead will typically comprise a number of ejectors, each of which can be made to eject a volume of ink depending on the voltage applied at the ejection locations.

Various printhead designs have been described in the prior art, such as those in WO 93/11866, WO 97/27058, WO 97/27056, WO 98/32609, WO 98/42515, WO 01/30576 and WO 03/101741.

In order to achieve consistent ejection of ink from the printhead, precise control of the static pressure of the ink is required at the ejection locations. The ink pressure may be controlled through a combination of air pressure and gravity by using a reservoir with a weir which feeds the printheads, the difference in height between the top of the weir and the ejection locations determining the total depth of ink and, thus, the pressure due to gravity. A printhead in which the ejectors are at differing heights will experience varying ink pressures across its length which will cause a corresponding variation in ejection performance.

To print on a cylindrical object, one or more printheads may be aligned such that their ejectors are arranged parallel to the longitudinal axis of the object, which may then be rotated around its longitudinal axis as the printhead ejects a series of droplets onto its surface, allowing an image to be formed thereon.

US 2011/0232514 A1 discloses an apparatus for printing on bottles wherein the bottles are carried in a horizontal plane with their longitudinal axes being held vertical during printing. A single electrostatic printhead prints onto each bottle whilst moving along substantially the same path as the bottle.

The geometry of this printing apparatus requires that each printhead is aligned with its ejection locations arranged along a vertical axis. A pressure gradient is likely to exist between the different ejection locations which will require a complex ink feed apparatus and calibration process to produce high quality images.

WO 2012/147612 A1 discloses a printing apparatus wherein cans are printed upon by a number of printheads while both the cans and the printheads are moved in conjunction through a vertical plane.

The plurality of orientations of the printheads as disclosed here, which are additionally subjected to accelerating forces as they follow a circular motion, are also likely to require a complex ink feed apparatus and calibration process in order to produce high quality images.

US 2013/0269551 A1 discloses a printing apparatus wherein bottles or cans mounted on a carrier with their principal axes vertical are moved horizontally between print stations. The print stations are moved vertically relative to the bottles or cans, to bring them into and out of the vicinity of one another.

This apparatus also comprises vertically aligned ejectors, which will suffer from the disadvantages described above.

WO 2012/131478 A2 discloses a printing apparatus in which a cylindrical objects are carried by holding devices through a single vertical path comprising multiple printhead stations.

U.S. Pat. No. 6,769,357 B1 discloses a can printing apparatus wherein cans are carried through a substantially circular path between a series of printhead stations. The apparatus discloses a number of printhead stations comprising printheads in different orientations. Such a system would require a complex ink feed system to maintain the correct ink pressure at the various ejection locations.

Also, in many cases it is not possible for the entire image to be formed by a single printhead during one rotation of the object. It may be the case, for instance, that the image is formed of several colours, each of which must be printed by a different printhead. It may also be the case that, in order to achieve the desired print resolution or density, each ejector is required to make several passes over the object. Also, if the longitudinal extent of the object is greater than the width of a single printhead, several printheads may need to be positioned in order to span the entire surface. Alternatively, the same printhead may be moved relative to the object over several passes.

This general inability of a single inkjet printhead to form a complete image on a cylindrical object during a single pass is one factor which limits the rate at which cylindrical objects can be printed upon. The other limiting factor is the maximum rate at which a single printhead can print, which is generally a fixed characteristic of the type of printhead used and may not be increased.

In order to overcome this limitation and, thereby, increase the throughput of a printing system, it is necessary to perform multiple print operations in parallel. This may be achieved by several printheads at a printhead station simultaneously printing upon the same object, or several printhead stations which simultaneously print upon different objects. In general, it is possible to have a series of printhead stations, each of which comprises a number of printheads, arranged such that at each printhead station a cylindrical object is being printed upon by several printheads. The cylindrical objects may then be carried from one printhead station to the next in order that different aspects of the image may be printed at the different printhead stations. Using this technique, the total rate of print operations occurring simultaneously can be increased from that possible using a single printhead by a factor of $N_p \times N_s$, where $N_p$ is the number of printheads at each printhead station and $N_s$ is the number of printhead stations in total. While $N_s$ is not limited, there is only sufficient space for a certain number of printheads, $N_p$, to be arranged such that they are able to simultaneously print into the same object. Furthermore, there are several reasons why using the maximum number of printheads which may print onto the same cylindrical object is not necessarily the optimum arrangement.

A problem arises when multiple printheads are oriented differently to eject ink in different directions. The ink feed apparatus which feeds the printhead ejectors must be maintained at a fixed orientation in order to regulate the pressure and flow of ink correctly to the ejectors. Therefore having multiple printhead orientations requires a more complicated design of the ink feed system for each printhead, which can be oriented independently of the printhead, adding to its physical size and complexity. Another problem with this arrangement is that the pressure control of each ink feed must be set independently to account for the different hydrostatic pressure that results from the variable height between the ink feed and the printhead ejectors when the printhead is arranged in different orientations, adding complexity to the operation of the ink feed apparatus.

Furthermore, if the ejectors of a single printhead do not lie in the same horizontal plane, the ink pressure at each ejection location will vary, affecting the ink output across the printhead and the quality of the printed image.

A further problem occurs when printheads are oriented to eject ink at an angle above the horizontal, as dust and other airborne particles are likely to settle onto the printing face of the printhead and compromise the reliability of ejection.

Furthermore, as it is necessary for an object to be printed on to be carried from one printhead station to the next, it is desirable that the arrangement of printheads at each printhead station does not obstruct the preferred path of the objects or holding devices between the printhead stations. Were the cylindrical surface of the object to be surrounded on all sides by printheads, it would require a highly complex motion of its holding device to extricate it from a first printhead station and another complex motion to position it in a second printhead station, compromising throughput and making the accurate registration of print from station to station very challenging.

There is a need to provide an arrangement of printheads and printhead stations which provides as great a throughput of objects as possible, without compromising the effectiveness of the printhead operation or making the movement of the objects between printhead stations impractical.

SUMMARY OF THE INVENTION

The present invention provides an apparatus for printing on substantially cylindrical objects. A substantially cylindrical object may be an object with a substantially constant cross section along at least portion of its length. It may also be an object which is substantially rotationally symmetric around a longitudinal axis along at least a portion of its length. Examples of substantially cylindrical objects include but are not limited to cans, bottles and tubes.

One embodiment of the present invention comprises a plurality of printheads; and at least one holding device movable relative to the printheads such that, in use, the holding device moves the object between the printheads, wherein the path of the at least one holding device comprises a plurality of vertical sections which are horizontally offset from one another, wherein each vertical section comprises at least two identically orientated printheads arranged such that they are vertically displaced from one another, with one directly above the other; and wherein the at least one holding device moves the object between the at least two printheads such that part or all of its path between the printheads is vertical.

This arrangement and orientation of printheads allows a more efficient method of bringing objects to be printed into the vicinity of printheads and then printing on said objects than is already known. By having the printheads arranged along a plurality of vertical paths, several individual printheads are able to function with their ejector arrays lying parallel to a horizontal plane, simplifying the pressure distribution across the ejection locations. Furthermore, by specifying that each printhead is identically oriented with respect to the horizontal plane, the ink feed set up required to deliver the correct pressure and flow rate of ink to the printheads can be further simplified.

The provision of a holding device that moves through a plurality of vertical paths allows for a number print systems providing a large throughput while minimizing the required complexity of the ink feed systems and printhead calibration processes. A single holding device may be used to carry one cylindrical object through a number or vertical paths, or, alternatively, perform a cycle within which a number of cylindrical objects are successively loaded and unloaded.

In another embodiment an apparatus for printing on cylindrical objects is provided, comprising a plurality of printhead stations arranged such that at least two of the printhead stations are horizontally offset from each other, wherein each printhead station comprises at least two printheads arranged such that they are at the same height and horizontally displaced from one another, thereby forming a gap between them through which a cylindrical object to be printed on my pass; and at least one holding device movable relative to the printheads such that, in use the holding device moves the object between the printheads such that part of its path between the printheads is vertical.

The vertical path through which the individual objects are carried again allows an optimal orientation of the printheads which simplifies the ink feed system needed to feed the ejectors. Furthermore, the placing of printheads on two sides of a gap through which the objects may be carried allows a greater number of printheads to simultaneously print onto the surface of the objects, increasing the number of parallel printing operations which may take place and, therefore, increasing the throughput of objects.

Another aspect of the invention provides apparatus for printing on cylindrical objects comprising at least one printhead station having at least one printhead with a linear array of ejectors, each of the at least one printheads being oriented at the same angle to the horizontal plane; and at least one holding device for holding a cylindrical object and moving the cylindrical object to a vicinity of the at least one printhead station such that the at least one printhead can print on the cylindrical object, the holding device being configured to rotate the cylindrical object about its longitudinal axis whilst keeping the longitudinal axis of the cylindrical object parallel with the array of ejectors while they are printing.

This allows that the array of ejectors remains in the same horizontal plane whilst printing, keeping the ink pressure constant across the ejection locations. Individual printheads may be combined to form a system in which multiple print operations take place in parallel, with a simple calibration process and ink feed systems which do not need to be varied between neighbouring printheads.

DETAILED DESCRIPTION

The present invention provides an apparatus and method for digitally printing on cans 31 or other cylindrical objects 31 which allows a high throughput whilst maintaining optimum print quality.

Figure 1:
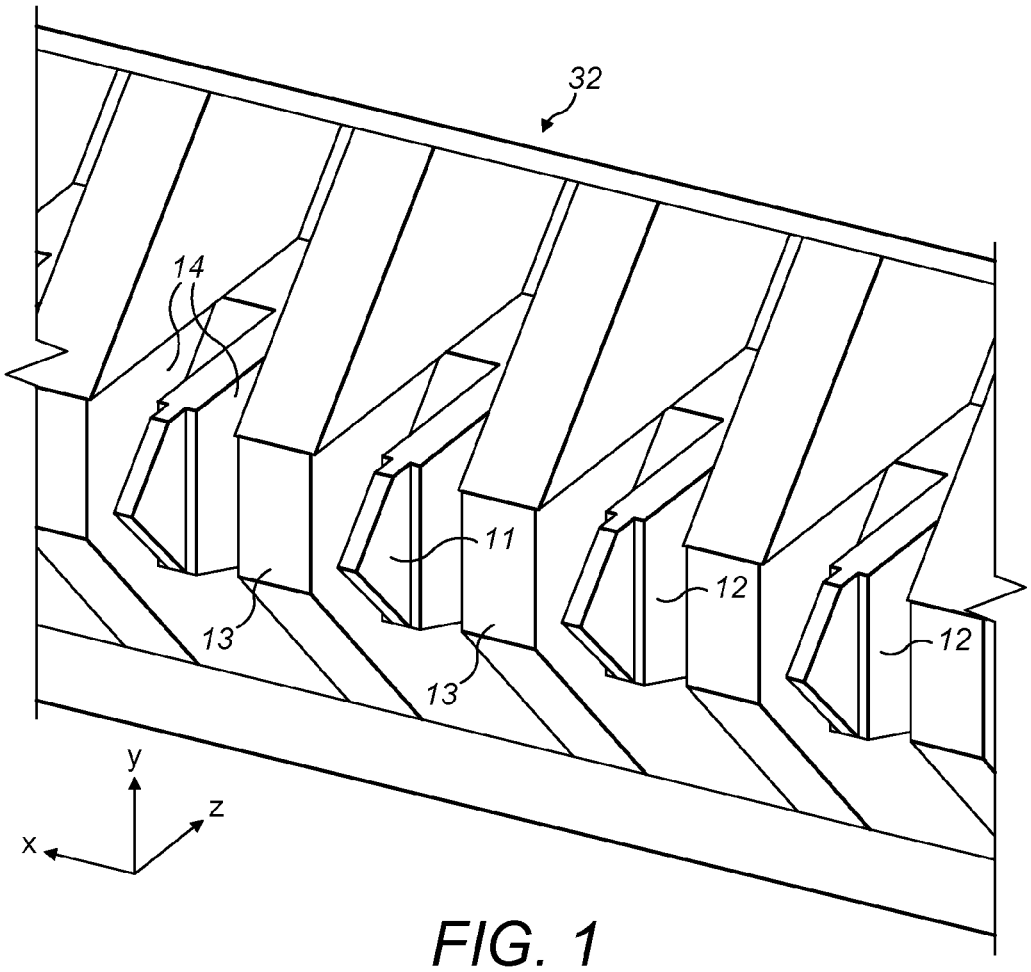
FIG. 1 shows part of an array of ejectors in a printhead of the type described in WO 93/11866 and WO 2012/89549.

FIG. 1 shows a printhead 32 comprising a linear array of ejectors 11, each of which can be made to eject a volume of ink with the application of an electric field between the ejection location and the substrate. Each ejector 11 is shaped with a narrow tip, around which ink flows, providing a highly localised ejection location. An ejection cell is defined by two dividing walls 13, also called a cheek, between which lies a central upstand 12. In each cell, ink flows in the two pathways 14, one on each side of the ejection upstand 12 and in use the ink meniscus is pinned between the top of the cheeks and the top of the ejection upstand. In this geometry the positive direction of the z-axis is defined as pointing from the substrate towards the printhead (typically along the shortest distance between the substrate and the ejection tips), the x-axis points along the line of the tips of the ejection upstands and the y-axis is perpendicular to these.

The orientation of each ejector is defined by its central axis, which is typically parallel to the z-axis as defined in FIG. 1. Such an axis may pass through the centre of the ejection tip and additionally or alternatively may be along or parallel to an axis of symmetry of the ejection tip. Additionally or alternatively, the axis may pass along or parallel to one or more of the layers in a laminate structure forming the ejector array, in particular along or parallel to the central tile discussed below.

Typically, the ejector array is formed as a laminate structure which includes at least an ink inlet manifold, an ink inlet prism, a central tile and an ink outlet manifold. The central tile has the array of ejection points formed along its front edge and both the central tile and the prism include channels for supplying ink to or from the ejector array.

Figure 2:
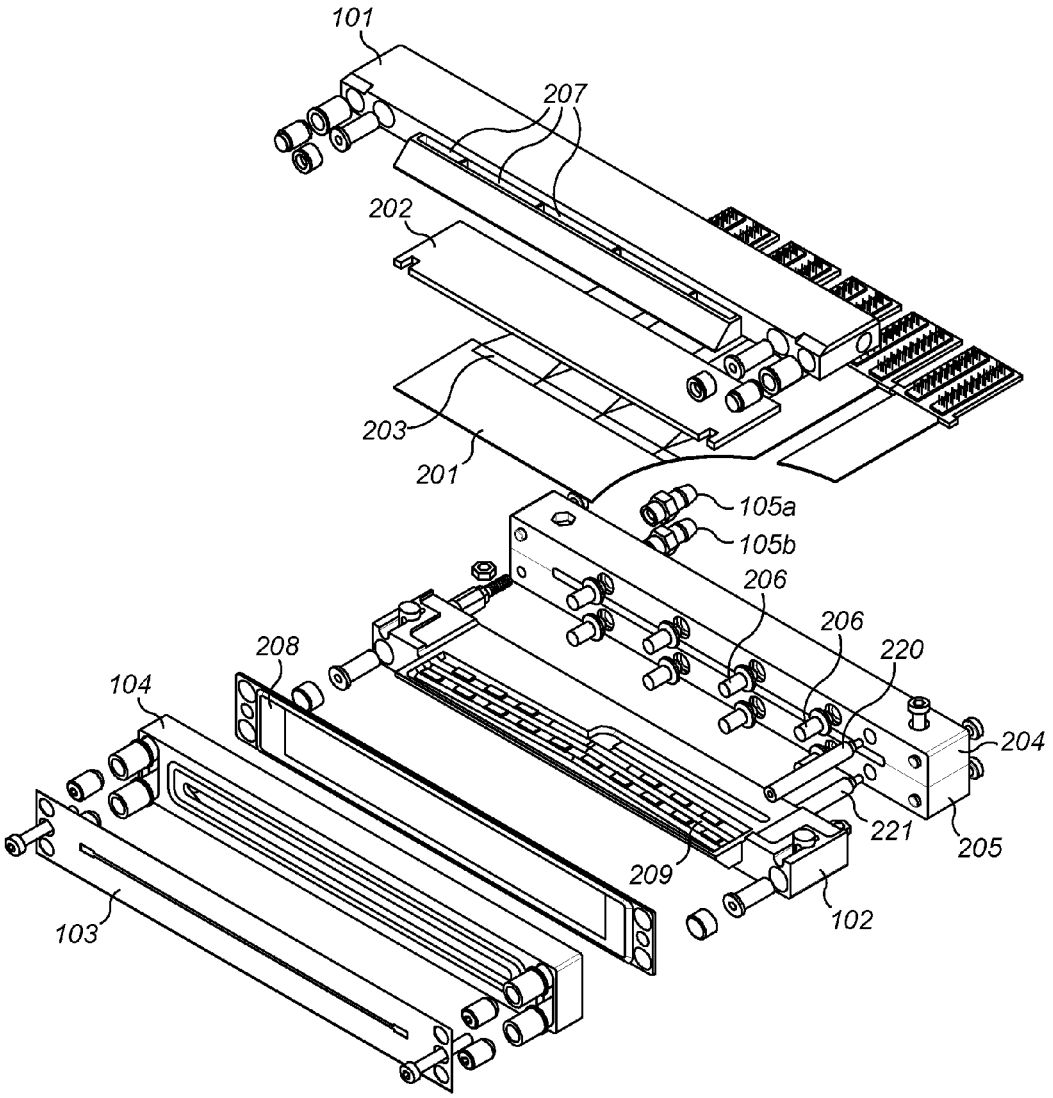
FIG. 2 shows an exploded view of a printhead of the type described in FIG. 1.
Figure 3:
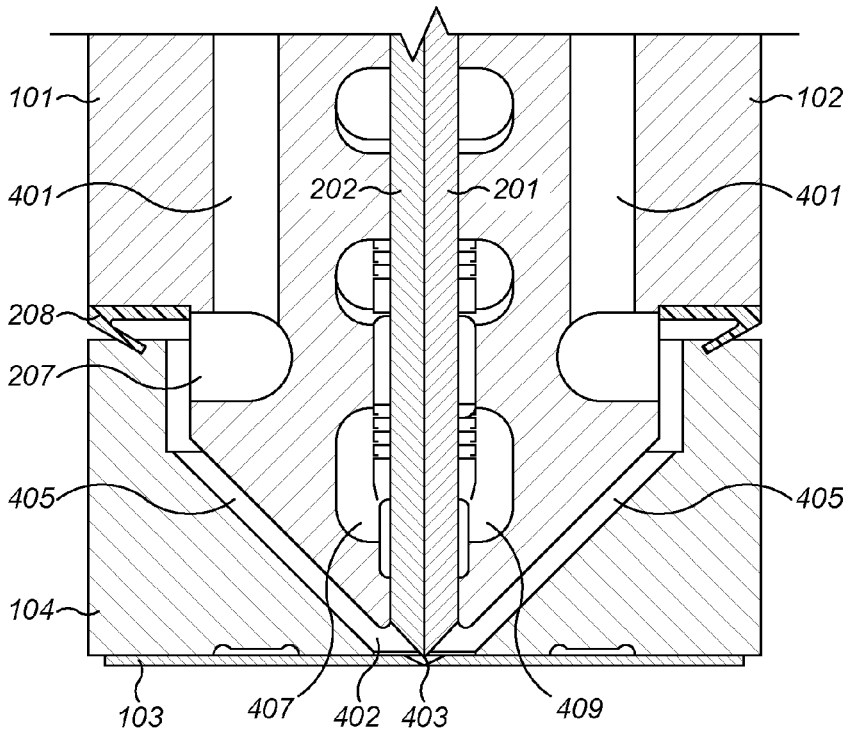
FIG. 3 shows a sectional view of the type of printhead described in FIG. 1.

With reference to FIGS. 1, 2 and 3, it can be seen that the main body of the printhead comprises the inflow block 101 and the outflow block 102, sandwiched between which are the prism 202 and the central tile 201. The central tile 201 has an array of ejection locations or tips 403 along its front edge and an array of electrical connections 203 along its rear edge. Each ejection location 403 comprises an upstand 12 with which an ink meniscus interacts (in a manner well known in the art). On either side of the upstand 12 is an ink channel 14 that carries ink past both sides of the ejection upstand 12. In use, a proportion of ink is ejected from the ejection locations 403 to form, for example, the pixels of a printed image.

The ejection of ink from the ejection locations 403 by the application of electrostatic forces is well understood by those of skill in the art and will not be described further herein.

The prism 202 comprises a series of narrow channels (not shown), corresponding to each of the individual ejection locations 403 in the central tile 201. The ink channels of each ejection location 403 are in fluid communication with the respective channels of the prism 202, which are, in turn, in fluid communication with a front portion 407 of the inlet manifold formed in the inflow block 101 (said inlet manifold being formed on the underside of the inflow block 101 as it is presented in FIG. 2 and thus not shown in that view). On the other side of the ejection locations 403, the ink channels merge into a single channel per ejection location 403 and extend away from the ejection locations 403 on the underside (as drawn in FIG. 3) of the central tile 201 to a point where they become in fluid communication with a front portion 409 of the outlet manifold 209 formed in the outflow block 102.

The ink is supplied to the ejection locations 403 by means of an ink supply tube 220 in the printhead 100 which feeds ink into the inlet manifold within the inflow block 101. The ink passes through the inlet manifold and from there through the channels of the prism 202 to the ejection locations 403 on the central tile 201. Surplus ink that is not ejected from the ejection locations 403 in use then flows along the ink channels of the central tile 201 into the outlet manifold 209 in the outflow block 102. The ink leaves the outlet manifold 209 through an ink return tube 221 and passes back into the bulk ink supply.

The channels of the prism 202 which are connected to the individual ejection locations 403 are supplied with ink from the inlet manifold at a precise pressure in order to maintain accurately controlled ejection characteristics at the individual ejection locations 403. The pressure of the ink supplied to each individual channel of the prism 202 by the ink inlet manifold is equal across the entire width of the array of ejection locations 403 of the printhead 100. Similarly, the pressure of the ink returning from each individual channel of the central tile 201 to the outlet manifold 209 is equal across the entire width of the array of ejection locations 403 and precisely controlled at the outlet, because the inlet and the outlet ink pressures together determine the quiescent pressure of ink at each ejection location 403.

The printhead 100 is also provided with an upper 204 and a lower 205 cleaning fluid manifold. The upper and lower cleaning fluid manifolds have respective inlets 105*a*, 105*b* through which rinse/cleaning fluid can be supplied to the printhead 100. The inflow 101 and outflow 102 blocks are both provided with cleaning fluid passages 401. The passages in the inflow block 101 are in fluid communication with upper cleaning fluid manifold 204 and those passages in the outflow block 102 are in fluid communication with the lower cleaning fluid manifold 205. Fluid connectors 206 link the cleaning fluid manifolds to the respective cleaning fluid passages.

The cleaning fluid passages 401 within the inflow and outflow blocks end at cleaning fluid outlets 207. The pathway to the ejection locations 403 continues along enclosed spaces 405 defined by the V-shaped cavity 402 in the datum plate 104 and the outer surfaces of the inflow 101 and outflow 102 blocks, until the point at which the ejection locations 403 themselves lie within the cavity 402. The two sides of the V-shaped cavity are, in this example, at 90 degrees to each other.

It can be seen that at the front of the printhead, an intermediate electrode plate is mounted on to a datum plate, which in turn is mounted onto the main body of the printhead. In FIG. 3, it is can be seen that the intermediate electrode is perpendicular to the central axis of each ejector tip. The intermediate electrode then forms a planar printing face of the printhead, whose orientation is defined by that of the ejector tips. Therefore, by orientating the printhead such that the axes of its ejector tips lie in a horizontal plane, the intermediate electrode can be orientated vertically, thereby allowing for an object to be carried past the printhead in a vertical path at a close enough distance to be printed upon.

Figure 4:
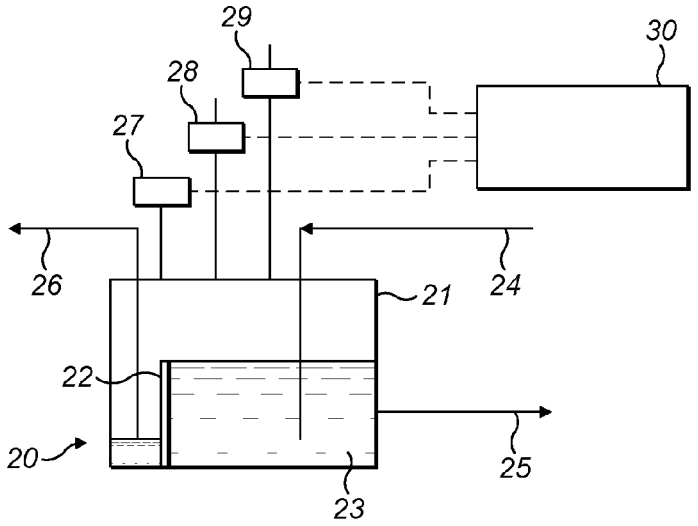
FIG. 4 is a schematic view of an ink reservoir with a weir.

FIG. 4 shows an ink reservoir 20 which is supplied with ink 23 from a remote location (not shown) through an inlet pipe 24. Ink exits the bottom of the reservoir via an outlet pipe 25 to a printhead (not shown). Disposed in the reservoir 20 is a weir 22 which separates the reservoir into a first chamber and a second chamber. Ink 23 is pumped into the first chamber through the inlet pipe 24 until it reaches the height of the top of weir 22 at which point it flows over the weir 22 into the second chamber. To operate correctly, the reservoir 20 must be maintained in an upright position so that the weir 22 properly determines the level of the ink in the reservoir 20. The fixed height of the weir fixes the volume of ink in the first reservoir and the vertical displacement between the surface of the ink and the printhead ejection location. Ink is removed from the second chamber by pumping the ink through an overflow return line 26. The overflow return line is configured to pump both ink and gas from the second chamber.

The air pressure in the reservoir 20 above the surface of the ink 23 is controlled and can be measured by a pressure sensor 27. Air can be either bled into or out of the reservoir 20 through an air bleed valve 28 (which can be supplied with air at any given pressure) or it can be pumped in or out of the reservoir by a pump 29 to maintain the pressure in the reservoir at a set point. The air pressure above the surface of the ink 23 in the reservoir 20 can be controlled in closed loop with the aforementioned pressure sensor 27 and set at a desired set point by control electronics 30, or programmed via a computer. Although air is described in this example, any other suitable gas may be used.

Such reservoirs 20 may be used to supply ink to, or receive unprinted ink from, a printhead by controlling the pressure set-point to be higher or lower than the ink pressure at the printhead tips respectively. In practice two such reservoirs 20 are used to control the ink pressure for the inlet and outlet of the printhead respectively.

Using this method, the pressure of ink at the printhead tips is substantially the average of the pressures of the two reservoirs 20 and the flow rate of ink through the printhead is determined by the difference in pressure between the two reservoirs 20.

Figure 5:
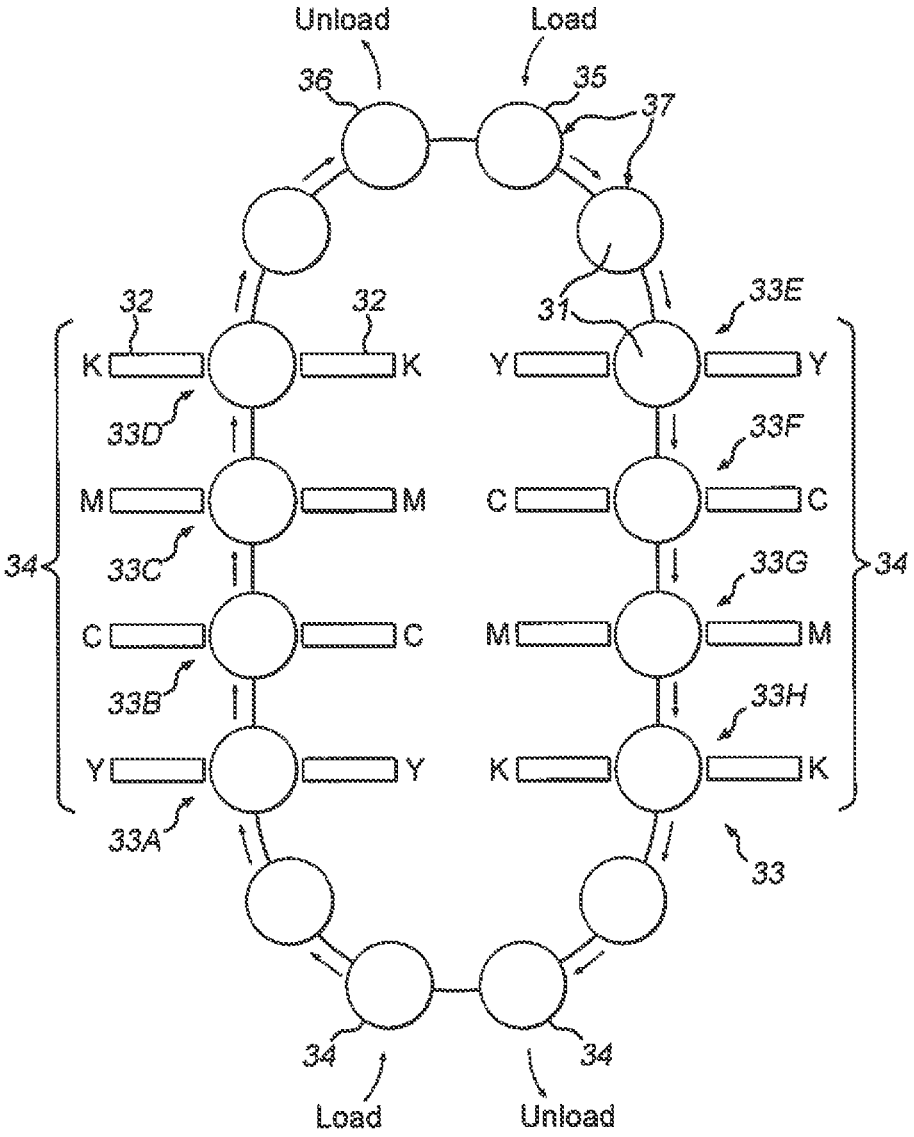
FIG. 5 is a schematic view of one embodiment of the present invention including two printheads per printhead station.

FIG. 5 shows a series of printhead stations 33 arranged in two vertical sections 34, with each vertical section being horizontally offset from the other. In the pictured embodiment the two vertical sections are at the same height, although the vertical sections may be vertically offset as well as horizontally offset in other embodiments. Each printhead station 33 comprises two printheads 32 which are oriented such that the axes of the ejectors are substantially horizontal and may simultaneously print onto the same object. The two printheads 32 at a printhead station 33 are arranged facing each other such that they form a channel, through which a cylindrical object may be passed with its longitudinal axis parallel to the ejectors of the printheads 32.

For any given printhead, all of the ejector axes will lie in a single horizontal plane. Typically, the axes of ejectors belonging to different printheads may or may not lie in the same plane.

During the printing process, a cylindrical object 31, which could be a can or a bottle, is carried by a holding device 37, which may be a mandrel or another device suitable for holding said cylindrical object, through a vertical path into the vicinity of one printhead station 33.

At the printhead station 33 the object 31 is rotated about its longitudinal axis, which is kept stationary while the object is being printed upon by each of the printheads 32.

When the printing step to be performed at that particular printhead station 33 has been completed, which may be after several revolutions of the object 31, the object 31 is then moved further along the vertical path until it arrives at a second printhead station 33, at which a second printing process is performed. The second printing process is, in this case, the printing of a different colour separation. Each object 31 will be brought to four printhead stations 33 in total, each printing a different colour separation. At the end of a vertical section, the object 31 is unloaded and the printing process is complete.

During operation, several objects 31 are processed by the apparatus simultaneously; each object 31 being carried by a separate holding device 37. A first object 31 is printed upon at a first printhead station 33 while a second object 31 is printed upon at a second printhead station 33, after which the first object 31 is taken to the second printhead station 33 and the second object 31 is taken to a third printhead station 33. At any one time each of the eight printhead stations 33 prints upon a different object 31.

In FIG. 5 it can be seen that as well as different objects 31 being at different stages of the same path, there are also parallel paths, such that while a first object 31 is taken between printhead stations 1-4 33A-D before being unloaded, a second object 31 is taken between printhead stations 5-8 33E-H before being unloaded.

A complete cycle for any one holding device 37 includes the following steps:

The holding device 37 is loaded with a first cylindrical object at a first loading point 35.

The cylindrical object is then carried by the holding device 37 between printhead stations 33 1-4, at each of which the holding device stops other than to rotate while the cylindrical object is printed upon.

The holding device 37 then moves to a first unloading point 36 where the cylindrical object is unloaded.

The holding device 37 then moves to a second loading point 35 where a second cylindrical object is loaded.

The second cylindrical object is then carried by the holding device 37 between printhead stations 33 5-8, at each of which the holding device 37 stops other than to rotate while the cylindrical object is printed upon.

The holding device 37 then moves to a second unloading point 36 where the second cylindrical object is unloaded.

The holding device 37 then returns to the first loading point 35 to repeat the cycle with a new object 31.

Figure 6:
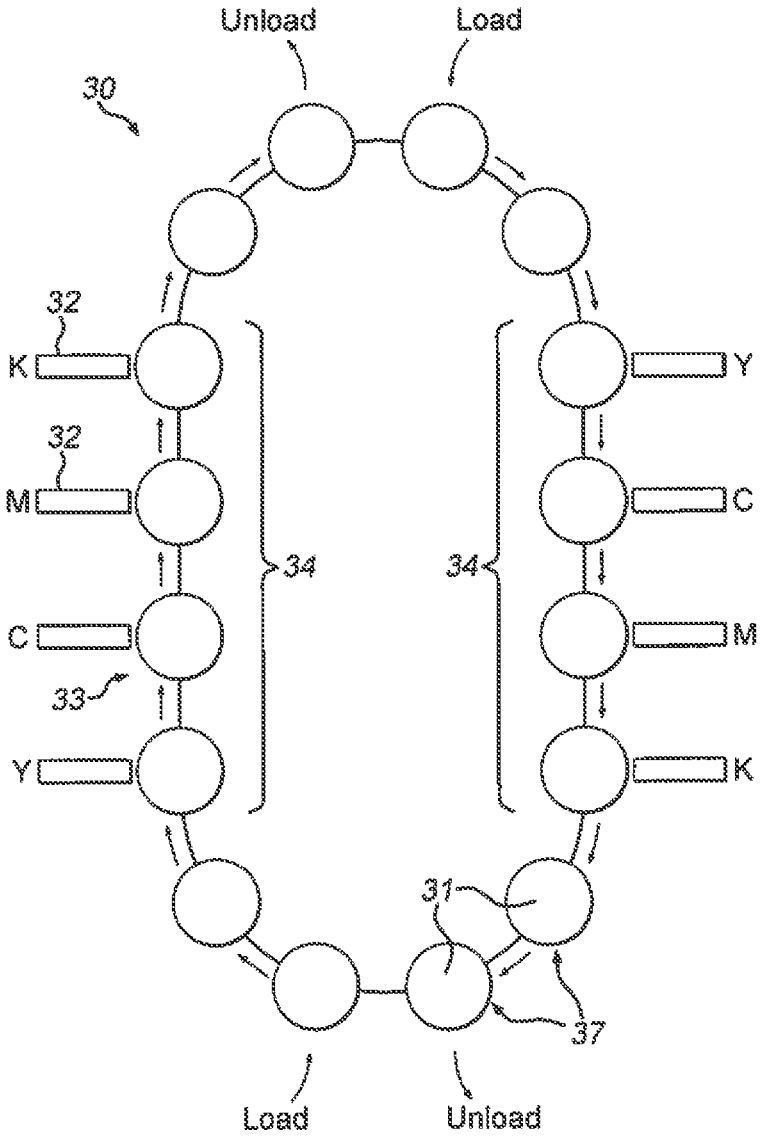
FIG. 6 is a schematic view of another embodiment of the present invention including one printhead per printhead station.

FIG. 6 shows an alternative embodiment, wherein there are eight printhead stations 33, each comprising one printhead and wherein each cylindrical object moves through only one vertical section containing four printhead stations 33 before being unloaded. Each printhead is identically orientated with respect to the horizontal plane having the axes of its ejectors substantially horizontal. In each vertical section, all of the ejectors of the printheads 32 lie in the same vertical plane. For any given printhead, all of the ejector axes will lie in a single horizontal plane. Typically, the axes of ejectors belonging to different printheads may or may not lie in the same plane.

Each vertical section is horizontally offset with respect to the other. In the pictured embodiment the two vertical sections are at the same height, although the vertical sections may be vertically offset as well as horizontally offset in other embodiments.

Figure 7:
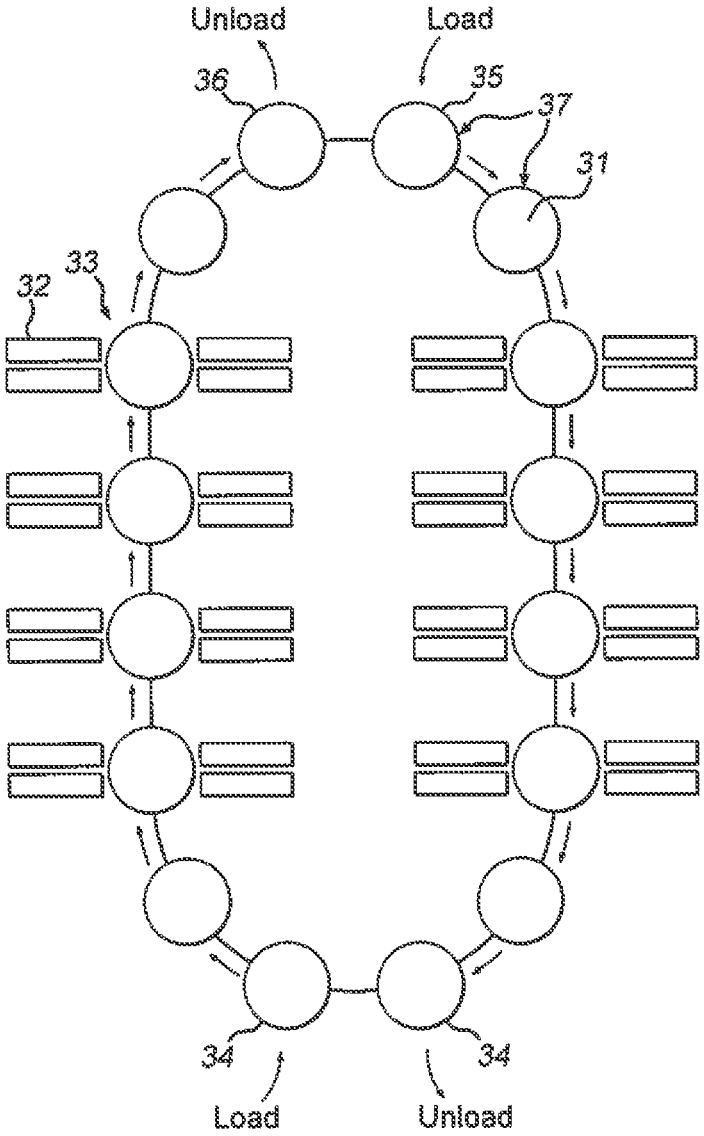
FIG. 7 is a schematic view of another aspect of the present invention including four printheads per printhead station.

In another embodiment, shown in FIG. 7, there are four printheads at each printhead station. In alternative embodiments, there may be more or fewer than 4 printheads at each printhead station.

In another embodiment, each cylindrical object may be taken to more than or fewer than four printhead stations 33.

In another embodiment, other stations may exist along the path of the cylindrical object, which process the object in other ways relating to the printing process, such as cleaning, inspection, pre-coating, extraction, heating, over-coating, fixing of the print, curing and the like.

In another embodiment, instead of being unloaded at the end of a first vertical section, the object 31 may be moved through a non-vertical path to the start of a second vertical section. The object 31 may then be moved through the second vertical section, stopping at multiple printhead stations 33, as in the first section. This may be repeated through any number of vertical sections.

In another embodiment, each object 31 may be taken to each printhead station 33.

In general, a series of printheads 32 may be oriented such that they lie substantially above one another. The ejectors of the printheads 32 may lie in a substantially vertical plane or, alternatively, in an inclined plane. The printheads 32 may only be displaced by a small distance, such that they are able to print onto the same object 31 simultaneously, thereby comprising a printhead station 33. The printheads 32 may also be displaced by a greater distance, such that an object 31 must be carried between them in order to be printed on by each of the printheads 32. In general, the printheads 32 may be arranged into a series of vertically displaced printhead stations 33, themselves comprising vertically displaced printheads 32. These sections of vertically displaced printheads 32 may be repeated such that an object 31 could be carried through a non-vertical path between neighbouring vertical sections. As in the above embodiments, a series of objects may be brought into the vicinity of a series of printhead stations 33 in sequence using several holding devices 37.

Figure 8:
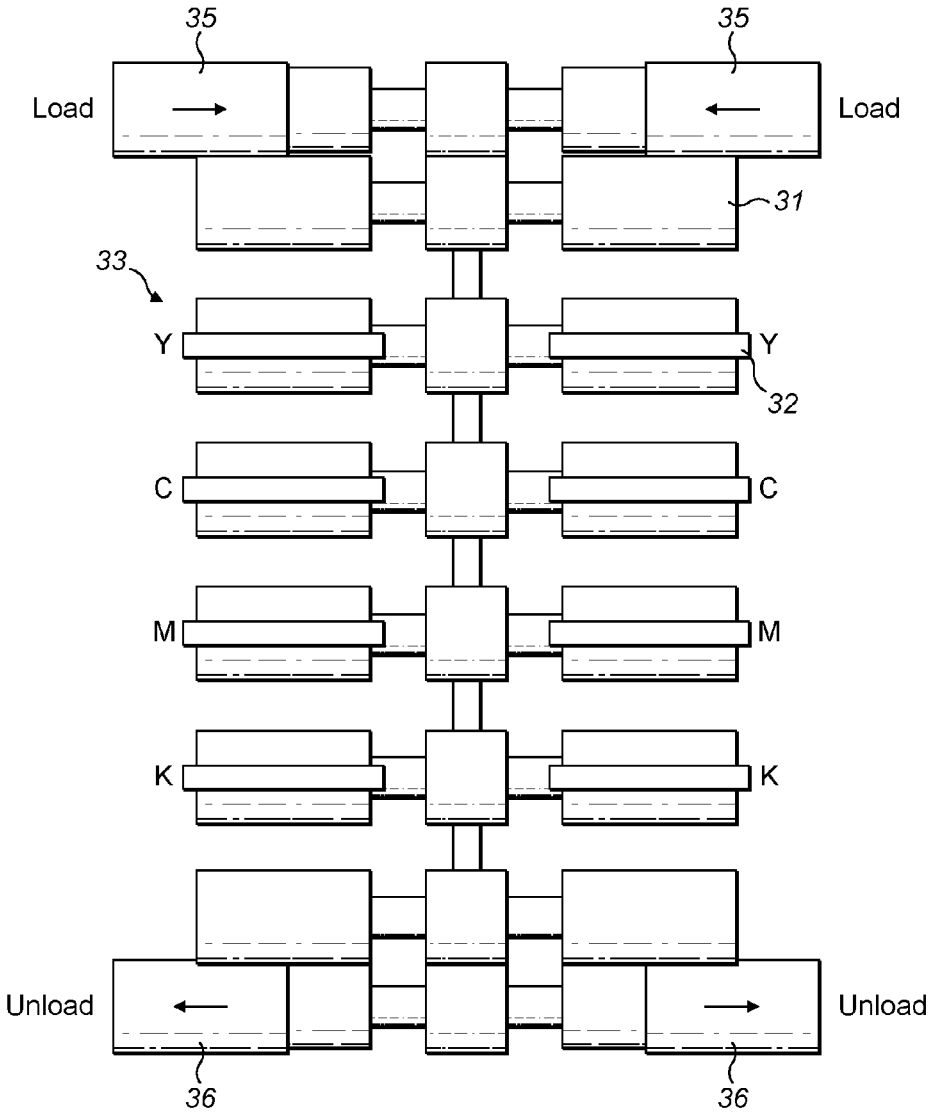
FIG. 8 is a side-view of an embodiment of the present invention where the arrangement of printhead stations is duplicated back-to-back.

FIG. 8 shows a side-view of another embodiment of the present invention in which the system is duplicated back-to-back in order to double the throughput. It may be more clearly seen in this side-view than in face on views that the printheads are aligned such that their ejection locations lie parallel to the longitudinal axis of the objects.

Figure 9:
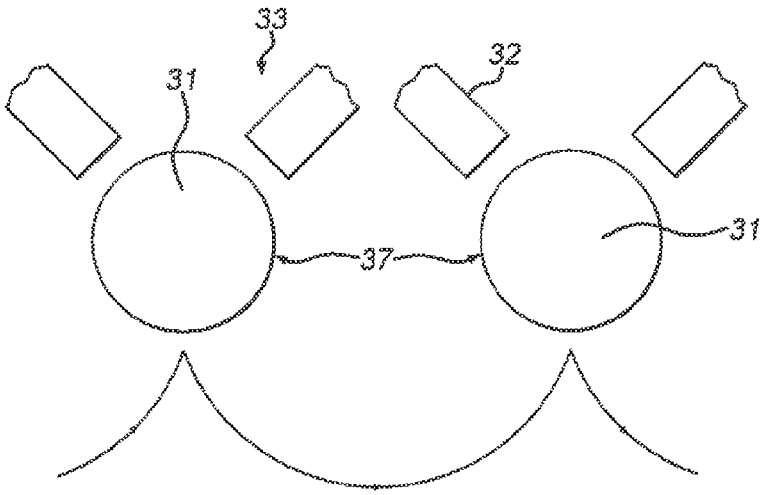
FIG. 9 is a schematic view of another aspect of the present invention including two printheads per printhead station and where the printhead stations are horizontally displaced.

FIG. 9 shows an apparatus wherein a plurality of printhead stations 33, each comprising two printheads 32 which are oriented with the axes of their ejectors in a horizontal plane, are offset horizontally with respect to one another. A holding device 37 carries objects 31 between printhead stations through substantially semi-circular paths.

In the pictured embodiment the printhead stations are at the same height, although the printhead stations may be vertically offset as well as horizontally offset in other embodiments.

Figure 10:
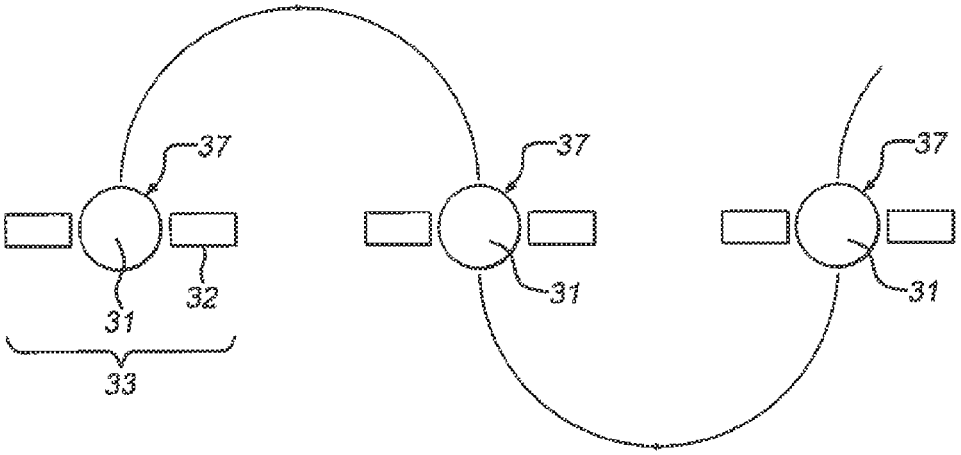
FIG. 10 is a schematic view of another aspect of the present invention including two printheads per printhead station, the two printheads being horizontally displaced such that a cylindrical object may be passed through a gap between them and the printhead stations also being horizontally displaced from each other.

FIG. 10 shows an apparatus wherein three printhead stations 33 are offset from one another horizontally and a plurality of holding devices 37 are arranged such that objects 31 may be passed into the vicinity of and then through successive printhead stations 33 in a series of substantially semi-circular paths. Each printhead station 33 is formed from two printheads 32 which are orientated with the axes of their ejectors in a horizontal plane and arranged to face each other such that they form a channel through which an object 31 may be passed. As in the above embodiments, a series of cans may be brought into the vicinity of a series of printhead stations 33 in sequence using several holding devices 37.

In alternative embodiments, there may be more or fewer than four printhead stations 33 and each printhead station 33 may comprise more or fewer than two printheads 32.

In another embodiment the paths may not be semi-circular but, instead, comprise horizontally displaced vertical sections connected through non-vertical connecting portions. In such an embodiment, the objects 31 would be brought into the vicinity of and through the printhead stations 33 during the vertical sections of the path.

Any of the above described embodiments may include printheads 32 which are displaced in a direction parallel to the longitudinal axis of the object 31. In other words, printheads 32 which are displaced along the axis of ejectors or transverse to the motion of the object 31 surface. If this displacement is small, i.e. less that the spacing between adjacent ejectors, the ejectors are said to be "interleaved", producing a smoother, higher resolution image. If the displacement is large, as in FIG. 11, the printheads 32 are said to be "stitched", extending the effective length of the array of ejectors in order to create a larger swathe width.

The "stitched" or "interleaved" printheads may be positioned on opposite sides of the object 31, or on the same side with a vertical offset allowing them to be overlapped.

Figure 11:
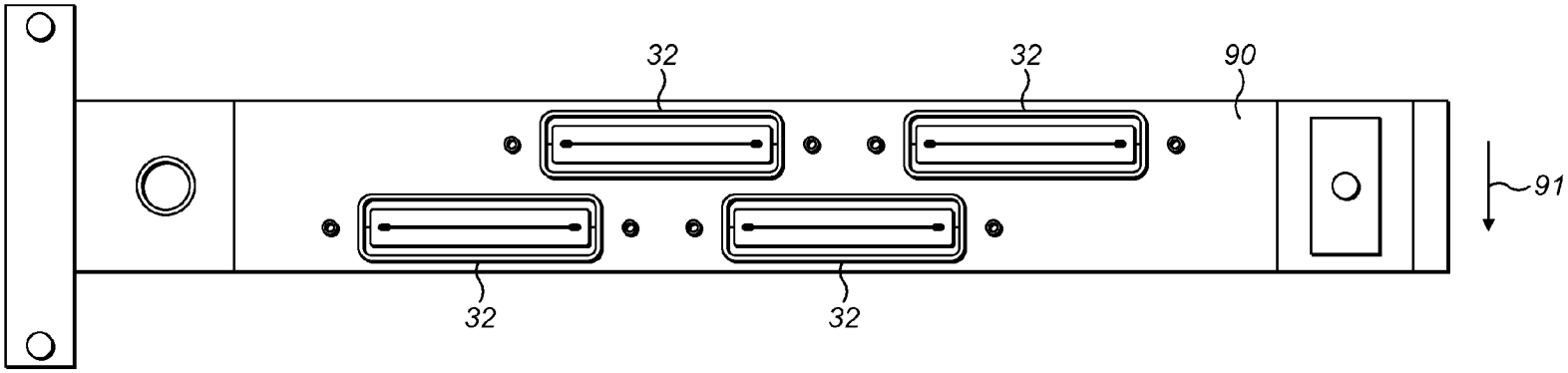
FIG. 11 shows "stitched" printheads, being arranged to provide a print width greater than the width of a single printhead.

FIG. 11 illustrates a printing bar or module 90 utilising four printheads 32, each having multiple ejectors 11 at a spacing providing 150 ejectors 11 per inch (60 ejectors 11 per centimeter) (150 dpi printing) to provide an appropriate swathe of the printed image in use, and with an overlap between each printhead 32 and its adjacent printhead(s) 32 such that a number of ejectors 31 (in this case 10) are overlapped between printhead pairs in the direction of print substrate movement (arrow 91) in order to stitch each swathe of print with it neighbour(s).

The printheads 32 may also be moved parallel to the axis of their ejector array (x-axis, FIG. 1) while printing in order to cover a larger area of the surface of the object 31 over a number of rotations of the object. The printheads 32 may also be moved parallel to the axis of their ejector array (x-axis, FIG. 1) intermittently between printing swathes of print in order to cover a larger area of the surface of the object 31.

The invention claimed is:

1. An apparatus for printing on cylindrical objects, the apparatus comprising:

a plurality of printheads; and at least one holding device movable relative to the printheads such that, in use, the holding device moves the object between the printheads, wherein the path of the at least one holding device comprises a plurality of vertical sections which are horizontally offset from one another, wherein each vertical section comprises at least identically two orientated printheads arranged such that they are vertically displaced from one another, with one directly above the other; and wherein the at least one holding device moves the object between the at least two vertically displaced printheads such that part or all of its path between the printheads is vertical.

2. The apparatus of claim 1, wherein at least two of the plurality of printheads are grouped into at least one printhead station, such that all of the printheads at one printhead station are able to print, preferably simultaneously print, onto the same object while the object is held stationary on the path in the vicinity of the printhead station.

3. The apparatus of claim 2, wherein:

the at least one printhead station is one of a plurality of printhead stations which are vertically displaced from one another and vertically aligned with one another, such that each printhead station is directly below or above another printhead station of the plurality of printhead stations.

4. The apparatus of claim 2, wherein:

the at least one printhead station is one of a plurality of printhead stations arranged in series, such that the holding device moves the cylindrical object to a vicinity of each printhead station of the series in turn.

5. The apparatus of claim 2, wherein the at least one holding device is a plurality of holding devices arranged in series, such that each holding device moves a respective cylindrical object to the vicinity of at least one printhead or printhead station in turn.

6. The apparatus of claim 2, wherein:

at least one printhead station comprises a plurality of printheads arranged in parallel, each with their respective arrays of ejectors arranged along parallel horizontal axes.

7. The apparatus of claim 2, wherein:

at least one printhead station comprises a plurality of printheads offset from one another in a direction parallel to the array of ejectors.

8. The apparatus of claim 2, wherein:

at least one printhead station comprises at least two printheads arranged such that they define a channel through which a holding device may move a cylindrical object in a substantially vertical path, while the longitudinal axis of the cylindrical object remains substantially horizontal.

9. The apparatus of claim 2, wherein:

the at least one holding device is one of a plurality of holding devices, each holding device being arranged to carry cylindrical objects between printhead stations, such that the paths between adjacent printhead stations comprise sections which are alternately substantially semi-circular and substantially vertical.

10. The apparatus of claim 1, wherein:

each of the at least two identically oriented printheads comprises a linear array of ejectors that is arranged along a horizontal axis.

11. The apparatus of claim 1, wherein:

the holding device is configured to rotate a cylindrical object around its longitudinal axis during printing, such that the longitudinal axis of the cylindrical object remains horizontal during printing.

12. The apparatus of claim 1, wherein:

the cylindrical object is one of a can or a tube or a bottle.

13. The apparatus of claim 1, wherein:

the path of the at least one holding device is substantially rectangular or discorectangular, in which there are two vertical sections.

14. The apparatus of claim 1, wherein:

the path of the at least one holding device comprises a plurality of vertical sections, through which the direction of travel of the holding devices alternates through the plurality of vertical sections between upwards and downwards over successive sections, such that if its path is upwards through one section its path is downwards through the following section and if its path is downwards through one section its path is upwards through the following section.

15. The apparatus of claim 1, wherein:

the path of the holding device forms a continuous loop, in which there are two loading points and two unloading points, with a sequence of printhead stations lying between the first loading point and the first unloading point, and with that sequence duplicated between the second loading point and the second unloading point.

16. A method of printing using the apparatus of claim 1, wherein:

at least one cylindrical object to be printed upon is carried along said path between the printheads or the printhead stations.

17. The method of claim 16, wherein:

the at least one holding device is first loaded with a cylindrical object when the holding device is at a first position, the holding device then carries the cylindrical object to a vicinity of at least one printhead station or printhead where it is printed upon, and the holding device then carries the cylindrical object to a second position at which the object is then unloaded before the holding device returns to the first position.

18. An apparatus for printing on cylindrical objects, the apparatus comprising:

a plurality of printhead stations arranged such that at least two of the printhead stations are horizontally offset from each other, wherein each printhead station comprises at least two printheads arranged such that they are at the same height and horizontally displaced from one another, thereby forming a gap between them through which a cylindrical object to be printed on may pass; and at least one holding device movable relative to the printheads such that, in use, the holding device moves the object between the printheads such that part of its path between the printheads at a printhead station is vertical.

19. The apparatus of claim 18, wherein:

all of the printheads at one printhead station are able to print, preferably simultaneously print, onto the same object while the object is held stationary on the path in the vicinity of the printhead station.

20. The apparatus of claim 18, wherein:

the holding device is configured to rotate a cylindrical object about its longitudinal axis during printing, such that the longitudinal axis of the cylindrical object remains horizontal during printing.

21. The apparatus of claim 18 wherein:

the at least one holding device is arranged to move an object to be printed on between successive printhead stations such that at least part of its path between successive printhead stations is vertical.

22. The apparatus of claim 18, wherein:

each of the at least two printheads at each printhead station comprises a linear array of ejectors that is arranged along a horizontal axis.

23. The apparatus of claim 18, wherein:

at least two of the printhead stations in the plurality of printhead stations are vertically displaced from one another, and vertically aligned with one another, such that one printhead station is directly below or above another printhead station of the plurality of printhead stations.

24. The apparatus of claim 18, wherein:

the printhead stations in the plurality of printhead stations are arranged in series, such that the holding device moves the cylindrical object to a vicinity of each printhead station of the series in turn.

25. The apparatus of claim 18 wherein:

the at least one holding device is one of a plurality of holding devices arranged in series, such that each holding device moves a respective cylindrical object to the vicinity of at least one printhead or printhead station in turn.

26. The apparatus of claim 18, wherein:

at least one printhead station has a plurality of printheads arranged in parallel, each with their respective arrays of ejectors arranged along parallel horizontal axes.

27. The apparatus of claim 18, wherein:

at least one printhead station comprises a plurality of printheads offset from one another in a direction parallel to the array of ejectors.

28. The apparatus of claim 18, wherein:

the cylindrical object is one of a can or a tube or a bottle.

29. The apparatus of claim 18, wherein:

at least two printheads are arranged such that they form a channel through which a holding device may move a cylindrical object in a substantially vertical path, while the longitudinal axis of the cylindrical object remains substantially horizontal.

30. The apparatus of claim 18, wherein:

the path of the at least one holding device is substantially rectangular or discorectangular, in which there are two vertical sections.

31. The apparatus of claim 18, wherein:

the path of the at least one holding device comprises a plurality of vertical sections, through which the direction of travel of the holding devices alternates through the plurality of vertical sections between upwards and downwards over successive sections, such that if its path is upwards through one section its path is downwards through the following section and if its path is downwards through one section its path is upwards through the following section.

32. The apparatus of claim 18, wherein:

the path of the holding device forms a continuous loop, in which there are two loading points and two unloading points, with a sequence of printhead stations lying between the first loading point and the first unloading point, and with that sequence duplicated between the second loading point and the second unloading point.

33. The apparatus of claim 18, wherein:

the at least one holding device is a plurality of holding devices, each holding device being arranged to carry cylindrical objects between printhead stations, such that the paths between adjacent printhead stations are substantially semi-circular.

34. A method of printing using the apparatus of claim 18, wherein at least one cylindrical object to be printed upon is carried along said path between the printheads or the printhead stations.

35. The method of claim 34, wherein the at least one bolding device is first loaded with a cylindrical object when the holding device is at a first position, the holding device then carries the cylindrical object to a vicinity of at least one printhead station or printhead where it is printed upon, and the holding device then carries the cylindrical object to a second position at which the object is then unloaded before the holding device returns to the first position.

* * * * *